US010132080B2

(12) United States Patent
Jensen

(10) Patent No.: US 10,132,080 B2
(45) Date of Patent: Nov. 20, 2018

(54) INSULATED CONCRETE PANEL TIE

(71) Applicant: IconX, LLC, Kansas City, KS (US)

(72) Inventor: Keith Jensen, Kansas City, KS (US)

( * ) Notice: Subject to any disclaimer, the term of this patent is extended or adjusted under 35 U.S.C. 154(b) by 0 days.

(21) Appl. No.: 15/437,886

(22) Filed: Feb. 21, 2017

(65) Prior Publication Data

US 2018/0238053 A1 Aug. 23, 2018

(51) Int. Cl.

| | |
|---|---|
| ***E04B 1/38*** | (2006.01) |
| ***E04C 2/288*** | (2006.01) |
| ***E04B 1/41*** | (2006.01) |
| *E04B 2/86* | (2006.01) |

(52) U.S. Cl.

CPC ..... *E04C 2/288* (2013.01); *E04B 1/41* (2013.01); *E04B 2/8635* (2013.01); *E04B 2/8652* (2013.01)

(58) Field of Classification Search

CPC ..... B28B 23/005; E04B 1/41; E04B 2/8635; E04B 2/8652; E04C 2/044; E04C 2/288; E04C 2002/047

USPC ..... 52/698, 626, 436, 422, 568, 565, 428, 52/309.16, 712; 249/216, 193, 218

See application file for complete search history.

(56) References Cited

U.S. PATENT DOCUMENTS 2,919,572 A * 1/1960 Salzi ..... E04B 2/30 52/381
3,676,967 A * 7/1972 Frati ..... E04B 2/8635 52/220.2
4,698,947 A * 10/1987 McKay ..... E04B 2/8641 52/309.11
4,730,422 A * 3/1988 Young ..... E04B 1/86 52/105
4,884,382 A * 12/1989 Horobin ..... E04B 2/8641 52/309.12
5,701,710 A * 12/1997 Tremelling ..... E04B 2/8617 52/309.16
5,704,180 A * 1/1998 Boeck ..... E04B 2/8652 249/216
5,890,337 A * 4/1999 Boeshart ..... E04B 2/8652 249/191
6,088,985 A 7/2000 Clark
6,308,484 B1 * 10/2001 Severino ..... E04B 2/8652 249/216
6,314,697 B1 * 11/2001 Moore, Jr. ..... E04B 2/8635 52/426
6,318,040 B1 * 11/2001 Moore, Jr. ..... E04B 2/8617 52/379
6,324,804 B1 * 12/2001 Hoogstraten ..... E04B 2/8652 249/191
6,352,237 B1 * 3/2002 Severino ..... E04B 2/8652 249/194
6,438,918 B2 * 8/2002 Moore, Jr. ..... B28B 19/003 52/309.11
6,609,340 B2 * 8/2003 Moore, Jr. ..... B28B 19/003 52/309.11

(Continued)

*Primary Examiner* — Chi Q Nguyen
(74) *Attorney, Agent, or Firm* — Polsinelli PC

(57) ABSTRACT

A concrete tie for use in an insulated concrete panel, the concrete tie including a main body having (1) a length, an inner surface, and an outer surface; (2) a protrusion extending away from the inner surface of the main body and along the length thereof; (3) at least one upper foot extending above a top surface of the main body and at least one lower foot extending below a bottom surface of the main body, wherein the protrusion is configured to engage with a slot formed in an insulation layer.

16 Claims, 6 Drawing Sheets

(56) References Cited

U.S. PATENT DOCUMENTS

| | | | |
|---|---|---|---|
| 6,860,454 | B1 | 3/2005 | Gronowicz, Jr. |
| 6,895,720 | B2 | 5/2005 | Keith |
| 8,839,580 | B2 | 9/2014 | Long, Sr. |
| 2004/0118067 | A1 | 6/2004 | Keith |
| 2006/0032166 | A1 | 2/2006 | Devalapura |
| 2012/0285108 | A1 | 11/2012 | Long, Sr. |

* cited by examiner

INSULATED CONCRETE PANEL TIE

FIELD OF THE INVENTION

The present disclosure relates generally to insulated concrete panels. In particular, the subject matter herein generally relates to an integrated concrete tie for use with an insulated concrete panel.

BACKGROUND

Insulated concrete panels are used throughout the construction industry and formed with an insulation layer sandwiched between an upper layer and bottom layer of concrete. In order to integrate the insulation layer with the upper and lower concrete layers, connectors (also known as "ties") can be implemented to form an insulated concrete panel. The connectors can integrate the upper layer of concrete with the lower layer of concrete through the insulation layer. As such, the connector(s) hold the insulated concrete panel(s) together while also providing a mechanism through which loads can be transferred between concrete layers.

Concrete ties for use within insulated concrete panels are known and used throughout the construction industry, but often require a large number of ties installed within the insulation layer at an individual job site, and thus become unwieldly and undesirable during use. In addition, many concrete ties are disposed through holes formed in the insulation layer, such as for example, the concrete ties described in US Publication Nos. 2004/0118067 and 2006/0032166. The holes are generally formed larger than the concrete tie itself to provide room for manipulation of the concrete tie and installation into a final position. The concrete ties presently used in the art can be used with insulation panels having a range of thicknesses, but must be reconfigured and/or redesigned to accommodate insulation panels exceeding the range of thickness.

Concrete ties can also be deployable between an uninstalled position allowing at least a portion of the concrete tie to pass through the hole and an installed position expanding the profile of the concrete tie and maximizing engagement with the concrete layer. The concrete ties can implement a retention housing, dam, two-piece mechanism, or other ancillary pieces to complete installation and secure the concrete tie within a hole of the insulation panel of the insulated concrete panel.

Specifically, Composite Technologies Corporation ("Thermomass") manufactures pin connectors for use in non-load transfer applications and concrete ties for load transfer applications. The load transfer concrete ties require holes to be formed within the insulation layer allowing portions of the concrete tie to be installed therethrough and extend beyond the insulation panel, and the concrete tie must installed at the job site during construction of the insulated concrete panel. The known concrete ties require extensive pre-processing of the insulation layer and labor intensive installation of the concrete tie at the construction site.

Therefore, it would be desirable for a wall tie to have a unique structure that ensures efficient and accurate placement on an insulation layer without requiring laborious installation. In addition, it is an object of the invention to provide a novel wall tie structure that forms a firmer and more secure bond to concrete and a strong connection between wythes, yet retains enough flexibility to not fail or break the concrete after installation. Moreover, it would be desirable to have an insulation layer for use with a concrete tie that requires minimal processing to accommodate and couple with the concrete tie, thereby ensuring efficient and accurate placement of the device.

BRIEF DESCRIPTION OF THE DRAWINGS

Implementations of the present technology will now be described, by way of example only, with reference to the attached figures, wherein.

SUMMARY OF THE INVENTION

Figure 1:
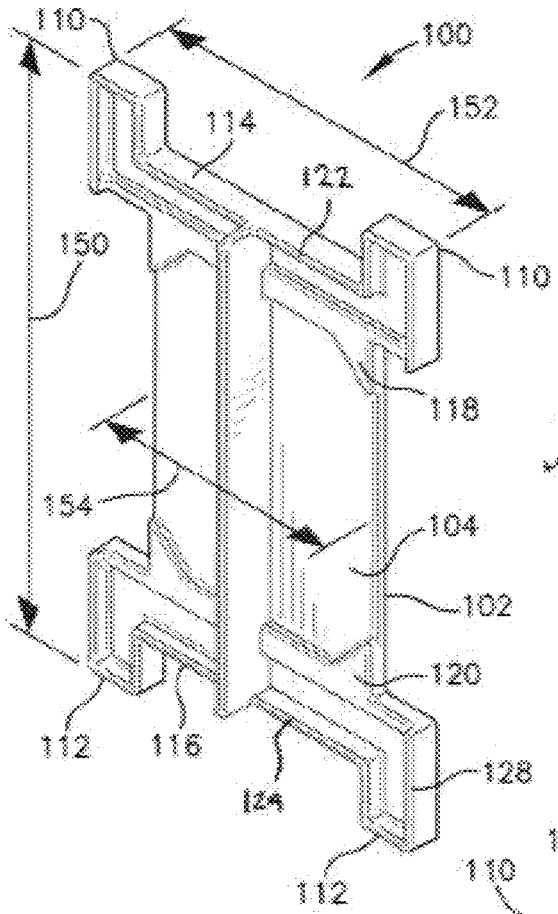
FIG. 1 is a front isometric view of a concrete connector according to an exemplary embodiment of the present disclosure.

The present disclosure is directed to a concrete tie for use within an insulated concrete panel. The concrete tie can include a main body having a length, an inner surface, and an outer surface. A protrusion can extend away from the inner surface of the main body and along the length thereof. The concrete tie can further include at least one upper foot extending above a top surface of the main body and at least one lower foot extending below a bottom surface of the main body. The protrusion can engage with a slot formed in an insulation layer or panel, thereby coupling the concrete tie both efficiently and accurately with the insulation panel.

The present disclosure is further drawn to a concrete tie system for forming an insulated concrete panel. The system can include at least one concrete tie having a main body comprising a length, an inner surface, and an outer surface. A protrusion can extend away from the inner surface of the main body and along the length thereof. The concrete tie can further include at least one upper foot extending above a top surface of the main body and at least one lower foot extending below a bottom surface of the main body. The concrete tie can be coupled with an insulation panel having a top surface, a bottom surface, and a plurality of side surfaces. The insulation panel can couple with at least one concrete tie along at least one of the plurality of side surfaces receiving the protrusion extending from the inner surface of the main body in a slot formed along the side surface. The concrete tie system can include an insulation layer formed by one or more abutting insulation panels each having one or more concrete ties disposed therein.

The insulated concrete panel can be formed by having an upper layer of concrete in contact with the top surface of the insulation layer and having the at least one upper foot disposed within the upper layer of concrete. A lower layer of concrete can be in contact with the bottom surface of the insulation layer and having the at least one lower foot disposed within the lower layer of concrete. The upper layer of concrete and the lower layer of concrete sandwich the insulation layer or panel, thereby forming an insulated concrete panel. The concrete tie provides structural rigidity and allows load transfer between the two layers of concrete.

Other aspects and interations of the disclosure are described more thoroughly below.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The terms "connector," "concrete connector" and "tie" are used interchangeably through the specification and each refer to the same element. The use of any one of these terms should be considered interchangeable and indistinguishable from the use of any other of the terms.

The following provides a more detailed discussion of the components herein.

FIG. 1 illustrates a concrete tie 100 in accordance with an exemplary embodiment of the present disclosure. The concrete tie 100 can have a main body 102 with an inner surface 104 and an outer surface 106 (shown more clearly in FIG. 2).

The concrete tie 100 can have a protrusion 108 extending away from the inner surface 104 and along a length 150 of the main body 102. The protrusion 108 can be blade-like, such that the distance of the protrusion 108 that extends away (depth) from the inner surface 108 is greater than the width (thickness) of the protrusion 108. The protrusion 108 can extend a first predetermined distance 130 away from the inner surface 108

The concrete tie 100 can further include at least one upper foot 110 extending above a top surface 114 of the main body 102 and at least one lower foot 112 extending below a bottom surface 116 of the main body 102. The upper foot 110 can extend substantially perpendicular to the top surface 114 and the lower foot 112 can extend substantially perpendicular to the bottom surface 116.

The main body 102 can have an upper width 152 formed at the top surface 114, a middle width 154, and a lower width 156 formed at the bottom surface 116. The upper width 152 and the lower width 156 can be substantially similar and greater than the middle width 154, thus forming a substantially "I"-shaped main body 102. The concrete tie 100 can include two upper feet 110 disposed at opposing ends of the top surface 114 and two lower feet 112 disposed at opposing ends of the bottom surface 116. The two upper feet 110 can be disposed at opposing ends of the upper width 152 and the two lower feet 112 can be disposed at opposing ends of the lower width 156, thus providing for wide spaced feet along the top surface 114 and bottom surface 116 respectively.

The main body 102 can have an upper support rib 118 extending along the middle width 154 and adjacent to the upper width 152 and a lower support rib 120 extending along the middle width 154 and adjacent to the lower width 156. The support ribs 118, 120 can provide lateral structural rigidity of the concrete tie 100. The upper rib 118 and lower rib 120 be formed at any point along the middle width 154 so as to be spaced apart from the upper width 152 and lower width 156 respectively. The concrete tie 100 can have fewer, or additional support ribs disposed across the width of the main body 102 to provide additional lateral support depending on the specific application use of the concrete tie 100. The reduced or added support ribs can allow the concrete connector 100 to have the appropriate stiffness for the particular implementation.

An upper lip 122 can be formed around at least a portion of a perimeter 126 formed around the upper width 152 and the at least one upper foot 110 and a lower lip 124 can be formed around at least a portion of a perimeter 128 formed around the lower width 156 and the at least one lower foot 112. The upper lip 122 and lower lip 124 can provide additional contact area for the concrete tie, while also providing structural integrity of the at least one upper foot 110 and at least one lower foot 112, and also help to align and center the concrete tie 100 in an insulation panel 200.

The length 150 of the main body 102 and the concrete tie 100 can and will vary depending on the project scope, thickness of insulation layer, and structural rigidity for a particular application. Preferably, the concrete tie 100 will have a length that is between about 6 inches and about 12 inches, which length is suitable for use with insulation layers having a thickness of up to about 8 inches. In a preferred embodiment, the length 150 of the main body 102 and concrete tie 100 is about 10 inches, which length is suitable for use with insulation having a thickness of about 6 inches. In other instances, the length of the main body and concrete tie can be increased to accommodate insulation having a thickness greater than 8 inches.

As can be appreciated in FIG. 1, the concrete tie 100 has a main body 102 having a protrusion 108 extending from the inner surface 104. The protrusion 108 extends the length 150 or longitudinal axis of the main body 102. The protrusion 108 is centrally located along the width of the inner surface 104. The main body 102 has two upper feet 110 extending from the top surface 114 disposed at opposing ends of the upper width 152 and two lower feet 112 extending from the bottom surface 116 at disposed at opposing ends of the lower width 156. The upper width 152 and lower width 156 are substantially the same and greater than the middle width 154, thus forming a concrete tie having a substantially "I" shaped main body 102.

As can be further appreciated in FIG. 1, the protrusion 108 extending away from the inner surface 108 generates a substantially "T"-shaped cross-section across the middle width 154, which provides multi-directional stiffness and load transfer in both the longitudinal axis (primary axis or protrusion 108) and the non-primary axis (middle width 154). This multi-directional stiffness is a unique feature of the invention since other concrete ties are designed and oriented to only provide stiffness along a single axis.

While the illustrated embodiment shows the concrete tie 100 having two upper feet 110 and two lower feet 112, it is within the scope of the present disclosure to implement a concrete tie with any number of upper feet 110 and lower feet 112, such as one, three, four, or more upper feet 110 and lower feet 112, respectively.

As can further be appreciated in FIG. 1, the concrete tie 100 has an upper rib 118 formed on the inner surface 104 and spanning across the middle width 154. The upper rib 118 can be adjacent to the upper width 152, such that the upper rib 118 is formed at the transition of the main body 102 from the middle width 154 to the upper width 152. The concrete tie 100 also includes a lower rib 120 formed on the inner surface 104 and spanning the middle width 154. The lower rib 120 can be adjacent to the lower width 156, such that the lower rib 120 is formed at the transition of the main body from the middle width 154 to the lower width 156. The ribs 118, 120 are located at the concrete insulation interface in an insulation panel 200. This interface is a highly stressed area of the tie and additional strength is required. The upper rib 118 and the lower rib 120 can provide lateral stability of the concrete tie 100 to reduce and/or prevent deflection relative to the upper width 152, middle width 154, and lower width 156.

The concrete tie 100 can be formed from a polymer or other plastic to provide strength and rigidity while minimizing thermal conduction. Any known structural, insulated or non-thermally conductive material can be implemented as a concrete tie 100 to maintain structural rigidity and reducing the heat transfer across the concrete tie 100. In at least one instance, the concrete tie 100 can be a fiber reinforced polymer (FRP).

The concrete tie 100 has an upper lip 122 formed around a perimeter 126 of the two upper feet 110 and the upper width 152 and a lower lip 124 formed around a perimeter 128 of the two lower feet 112 and the lower width 156. The upper lip 122 and the lower lip 124 extend away from the inner surface 106 of the main body 102 in similar fashion to that of the protrusion 108.

Figure 2:
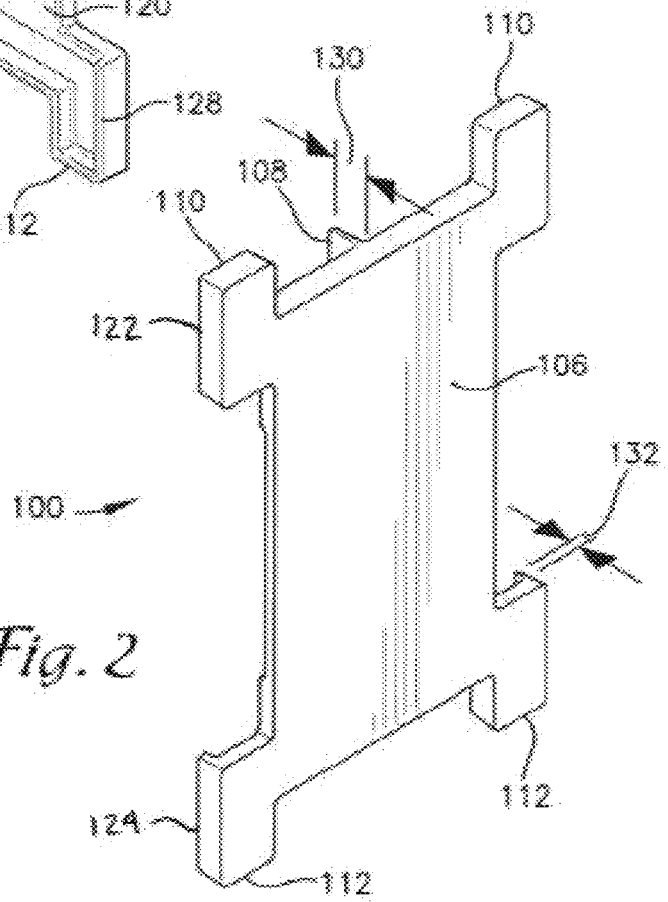
FIG. 2 is a rear elevational view of a concrete connector according to an exemplary embodiment of the present disclosure.

FIG. 2 illustrates a rear isometric view of a concrete tie 100 according the present disclosure. As can be appreciated in FIG. 2, the protrusion 108 can extend a first predetermined distance 130 away from the inner surface 104 and the upper lip 122 and the lower lip 124 can extend a second predetermined distance 132 away from the inner surface 104, the first predetermined distance 130 being at least twice the second determined distance 132. In other instances, the first predetermined distance 130 can be the same as the second predetermined distance 132 or can be any other ratio between the first predetermined distance 132 and the second predetermined distance 132.

The lower lip 124 and the second predetermined distance 132 can stiffen the concrete tie while the second predetermined distance 132 extends perpendicular to the inner surface 104 providing an enhanced bonding structure with concrete.

As can be appreciated in FIG. 2, the outer surface 106 can be substantially smooth or flat. In at least one instance, the outer surface 106 can have a textured or otherwise coarse outer surface 106, but lacks protrusions extending away therefrom.

Figure 3:
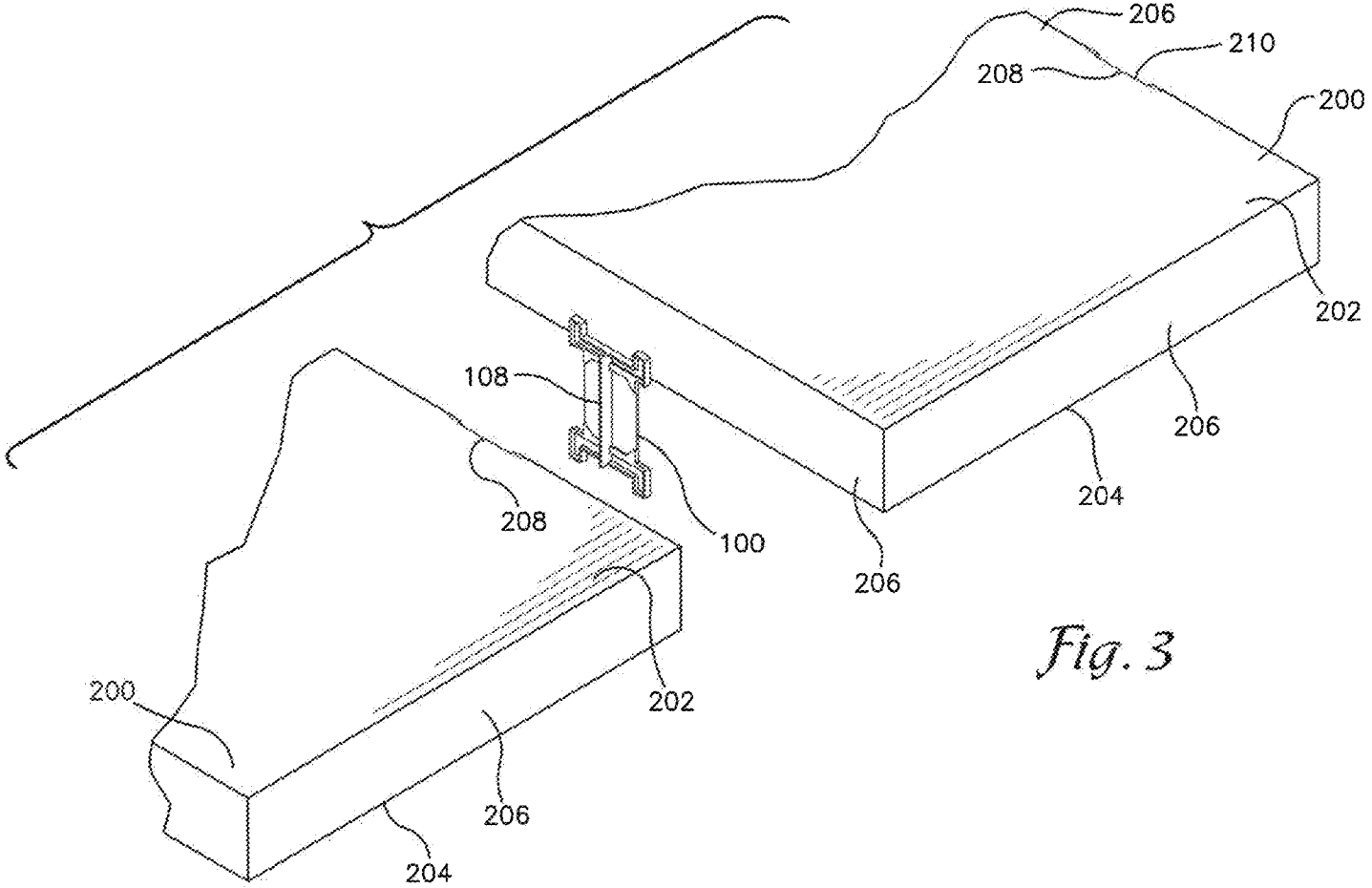
FIG. 3 is an exploded view of two insulation panels having a concrete connector installed therein according to an exemplary embodiment of the present disclosure.

FIG. 3 illustrates a concrete tie 100 installed in between two adjacent insulation panels 200. The insulation panel 200 can be a substantially rectangular panel having a top surface 202, a bottom surface 204, and a plurality of side surfaces 206. The insulation panel 200 can be formed from polystyrene foam, polyurethane foam, bonded wood fiber, bonded polystyrene beads, fiberglass, or any other insulated panel material.

The insulation panel 200 can be couplable with the concrete tie 100 along one or more of the side surfaces 206. Any side surface 206 can have a slot 208 formed therein and configured to receive the protrusion 108 extending from the inner surface 104 of the concrete tie 100. The slot 208 can be formed substantially vertically and extending between the top surface 202 and the bottom 204 of the insulation panel and be formed at a depth equal to or slightly greater than the first predetermined distance 130 of the protrusion 108, thus allowing the inner surface 104 of the concrete tie 100 to abut the side surface 206.

Figure 4:
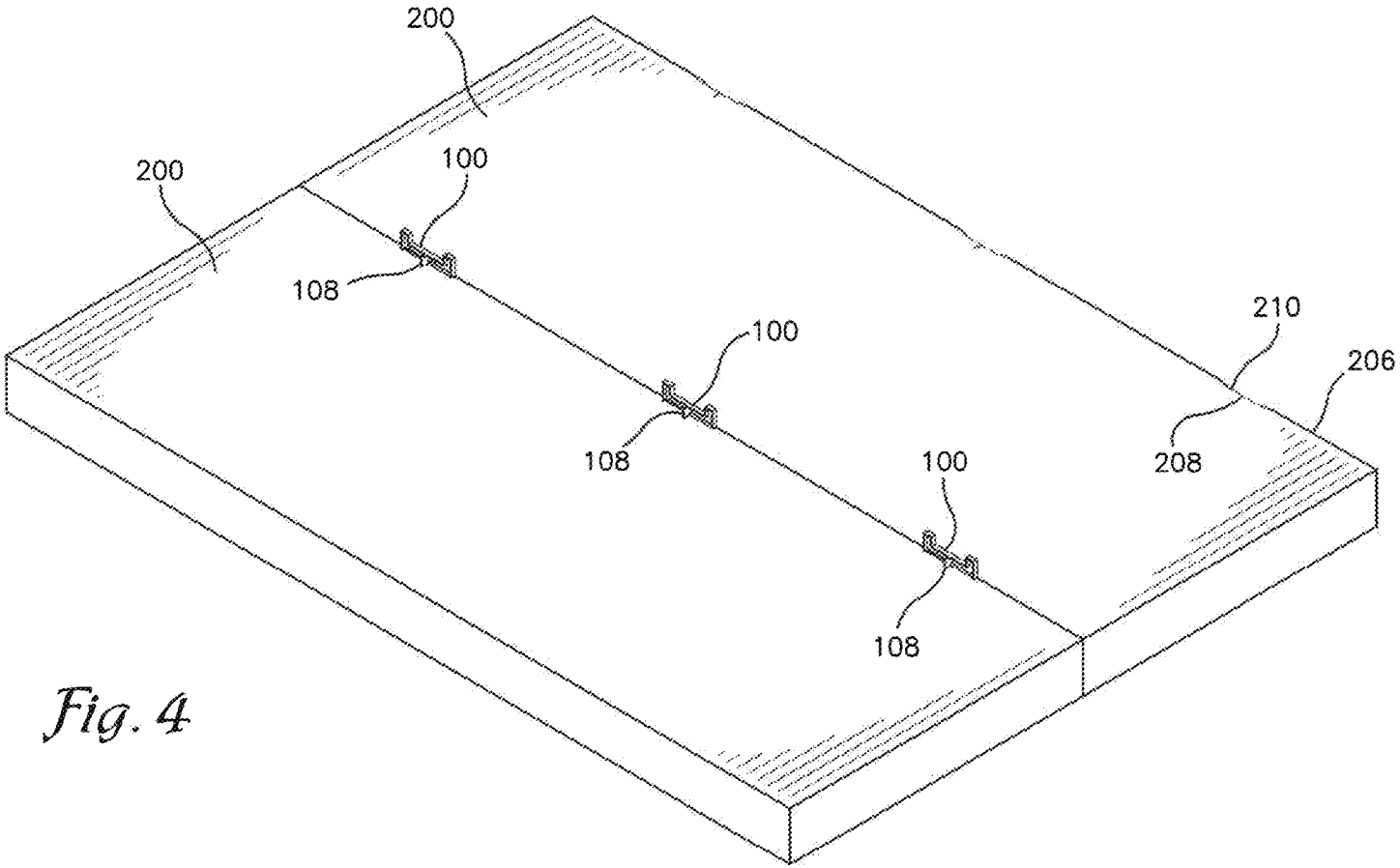
FIG. 4 is an isometric view of two insulation panels having a plurality of concrete connectors installed therein according to an exemplary embodiment of the present disclosure.

As can be appreciated in FIG. 4, the insulation panel 200 can couple with a plurality of concrete ties 100 along one or more of the plurality of side surfaces 206. The plurality of concrete ties 100 can be coupled along one of the side surfaces 206 and have an adjacent insulation panel 200 abuttingly engaged therewith.

The concrete ties 100 can generally be aligned and coupled along one of the side surface 106 having a longer length, thus allowing the stiff axis of the concrete tie 100 to resist shear forces within an insulated concrete panel.

As can further be appreciated in FIGS. 3 and 4, at least a portion of the concrete tie 100 extends above the top surface 202 of the insulation panel 200. The at least one upper foot 110 extends above the top surface 202 of the insulation panel 200 and the upper width 152 of the main body 102. In some instances, at least a portion of the main body 102 and protrusion 108 of the concrete tie 100 can also extend above the top surface 202 of the insulation panel. In other instances, only the at least one upper foot 110 and at least one lower foot 112 extend above the insulation panel 200. Similarly, at least a portion of the concrete tie 100 can extend below the bottom surface 204 of the insulation panel 200 allowing the at least one lower foot 112 to extend beyond the insulation panel 200.

The side surfaces 206 of the insulation panel 200 can have a recess 210 surrounding the slot 208. The recess 210 can be equal to or slightly wider than the middle width 154 of the concrete tie 100 and can have a depth sufficient to make the side surface 206 substantially flush with the outer surface 106 of the concrete tie. The recess 210 can allow the concrete tie 100 and insulation panel 200 to be coupled one with the other, such that adjacent insulation panels 200 can be flush and abuttingly engaged along the side surfaces 206 and eliminating gaps between adjacent insulation panels 200. In some instances, the recess 210 can be omitted providing a gap between insulation panels approximately equal to the thickness of the main body 102 of the concrete tie, such as 0.3 inches or 0.5 inches. Other thicknesses for the main body 102, and thus other gaps are within the scope of this disclosure.

As can be appreciated in FIGS. 3 and 4, the protrusion 108 extends away from the inner surface 104 of the concrete tie 100 and is received within the slot 208 formed on the insulation panel 200. The slot 208 is formed with a depth sufficient to receive the protrusion 108 and securely couple the concrete tie 100 with the insulation panel 200. The recess 210 accommodates the middle width 154 of the concrete tie 100, thus allowing the outer surface 106 to be substantially flush with the side surface 206. The side surface 206 can have a plurality of concrete ties 100 flushly coupled therewith and can abuttingly engage an adjacent insulation panel 200. The recess 210 can be spaced at a predetermined distance along the length of the side surface 206. The predetermined distance between recesses 210 and/or slots 208 can vary depending on the desired application and requirements of a particular implementation of the concrete tie 100 and insulation panel 200. In some instances, the recesses 210 and/or slots 208 are spaced at 1 foot intervals along the side surface 206. In other instances, the recess 210 and/or slots 208 can be formed and/or cut at 2 foot, 4 foot, 6 foot, or any other predetermined distance interval including non-consistently spaced intervals.

Figure 7:
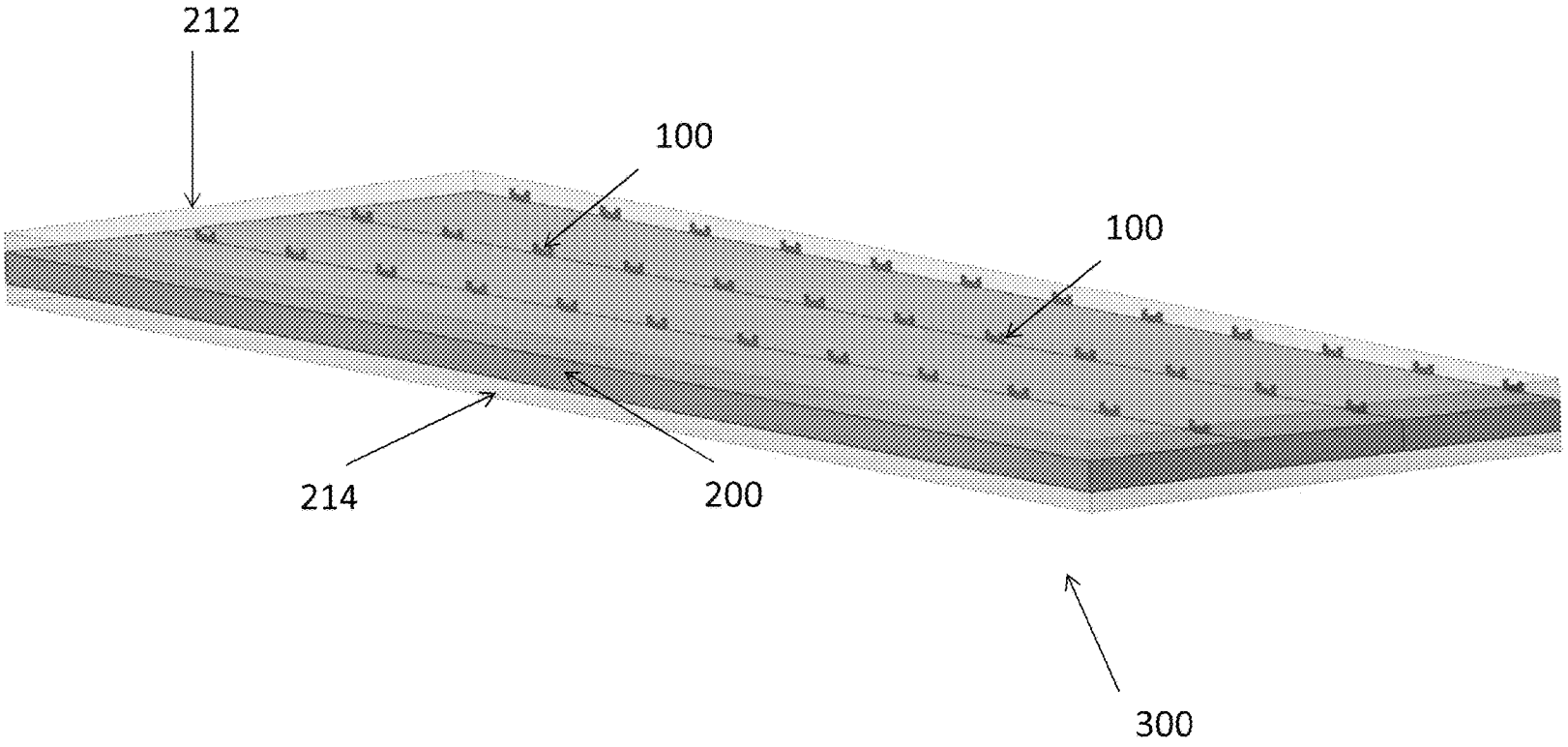
FIG. 7 is an isometric view of an insulated concrete panel having an insulation panel installed between an upper layer of concrete and a lower layer of concrete and a plurality of concrete ties installed therein according to an exemplary embodiment of the present disclosure.

As shown in FIG. 7, an insulated concrete panel 300 can be formed by combining an upper layer of concrete 212, an insulation panel 200 having at least one concrete tie 100 coupled therewith, and a lower layer of concrete 214. The insulated concrete panel can be collectively coupled by a concrete tie 100. The concrete tie 100 can have an upper foot 110 disposed within the upper layer of concrete 212 and can have a lower foot 112 disposed within the lower layer of concrete 214.

The upper foot 110 and lower foot 112 can allow load transfer between the upper layer of concrete and the lower layer of concrete, thus forming a more homogenous structural system. The upper width 152 and lower width 156 of the concrete tie allow for wide set upper feet 110 and lower feet 112 disposed within, and firmly bonded with, the upper layer of concrete and lower layer of concrete, respectively. The at least one upper foot 110 and at least one lower foot 112 along with the upper lip 122 and lower lip 124 provide the concrete tie with contact area within the respective concrete layer to allow load transfer. The concrete tie 100 can further add structural rigidity to the insulated concrete panel in addition to allowing load transfer between the upper layer of concrete and the lower layer of concrete.

As illustrated in FIGS. 4 and 7, the upper concrete layer 212 and lower concrete layer 214 can be poured concrete layers formed over the insulation panel 200, thus sandwiching the insulation panel 200 and concrete tie 100 between the upper concrete layer 212 and lower concrete layer 214. In some instances, the lower concrete layer 214 can be poured and formed. While the lower layer of concrete is still wet (or otherwise uncured), the insulation panel 200 having one or more concrete ties 100 coupled therewith can be placed having the lower feet 112 engaged with the lower layer of concrete and having the bottom surface 204 of the insulation panel 200 is in contact with the concrete. An upper layer of concrete 212 can then be poured over the top surface 202 of the insulation panel 200 and embedding the upper feet 110 in the upper layer of concrete 212 to form an insulated concrete panel 300.

Figure 5:
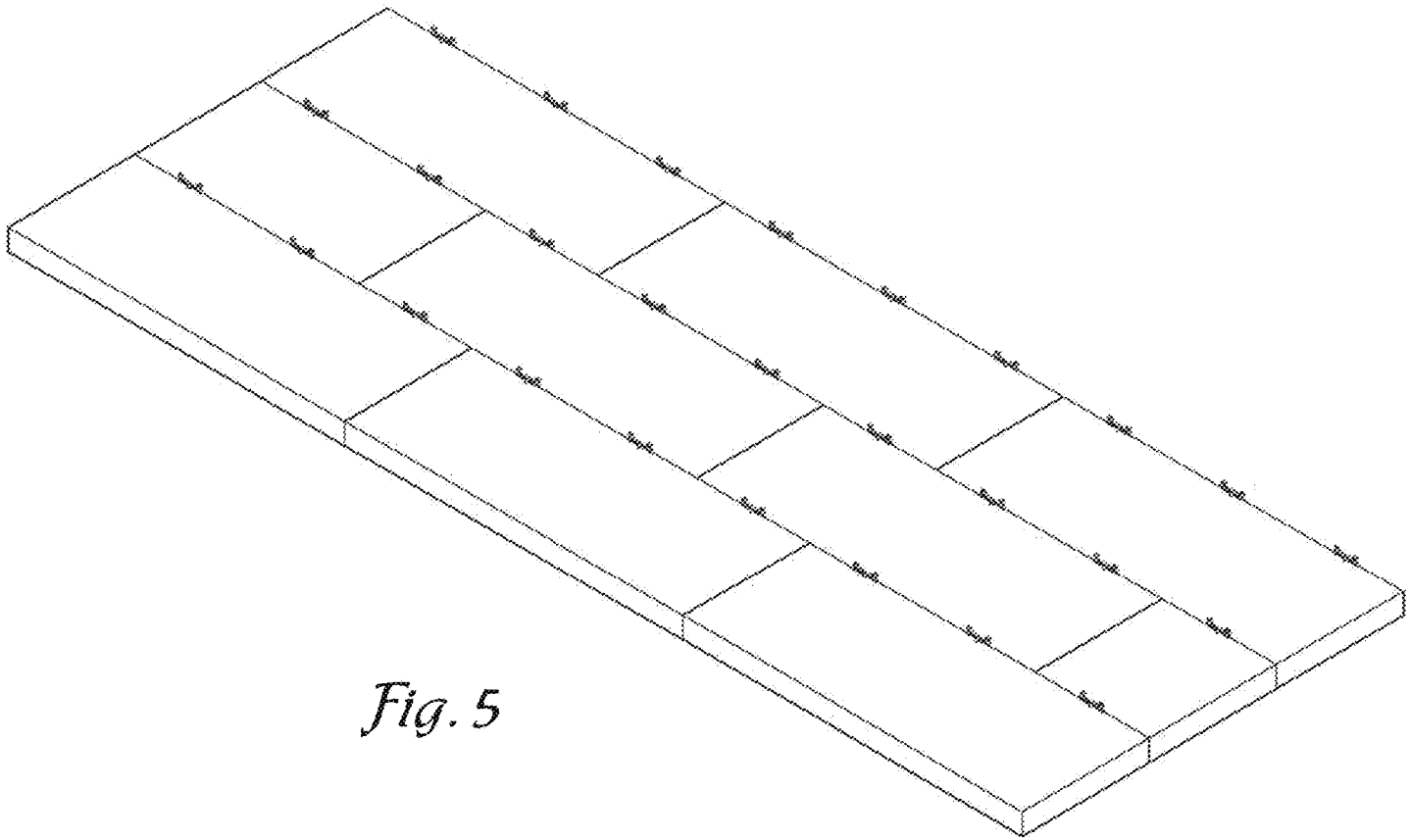
FIG. 5 is an isometric view of an insulation layer having a plurality of concrete ties installed therein according to an exemplary embodiment of the present disclosure.

FIG. 5 illustrates an insulation layer having a plurality of insulation panels. A plurality of insulation panels 200 can be arranged to form an insulation layer 250. The insulation layer 250 can include insulation panels 200 of varying size and shape depending on the desired insulate layer 250 and insulated concrete panel size and shape. Each of the insulation panels 200 within the insulation layer 250 can be coupled with a plurality of concrete ties 100. As can be appreciated in FIG. 5, the plurality of insulation panels 200 are arranged in a staggered formation and coupled with between one and three concrete ties 100 depending on the size of the insulation panel 200. The insulation panels 200 receive the concrete tie 100 within slot 208 and recess 210 allowing flush abutment between adjacent insulation panels 200.

Figure 6:
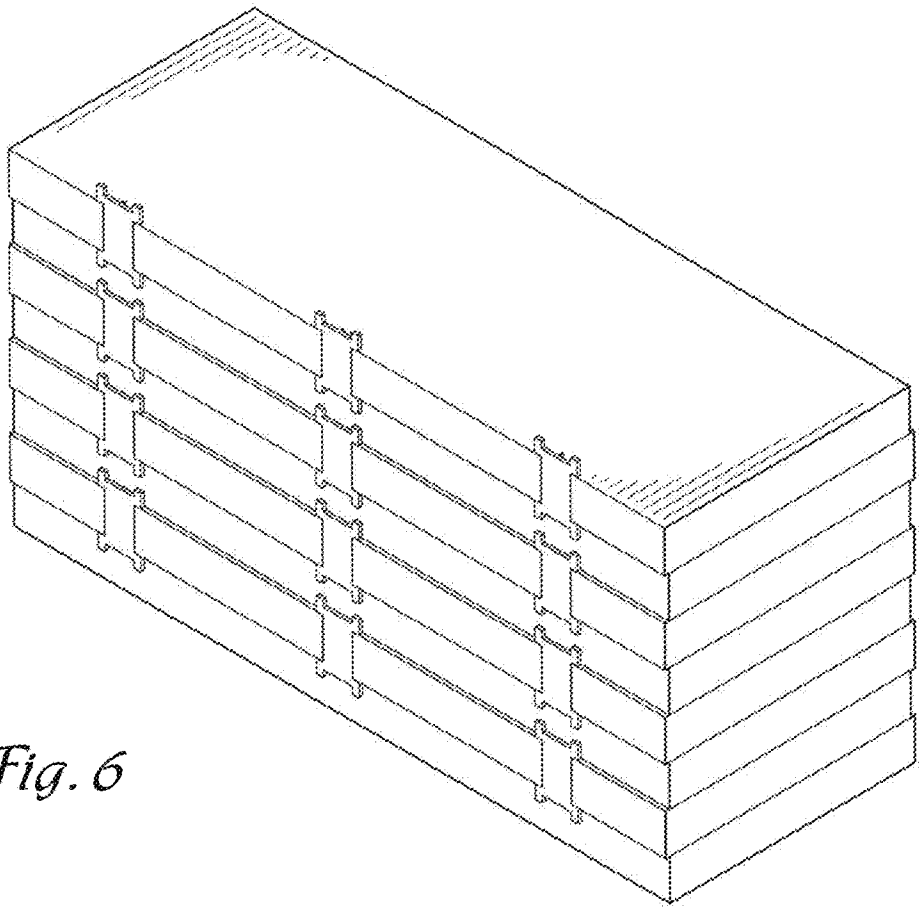
FIG. 6 is an isometric view of a plurality of insulation layers in a storage configuration according to an exemplary embodiment of the present disclosure.

FIG. 6 illustrates a plurality of insulation panels in a storage configuration. A plurality of insulation panels 200 can be stacked for storage, transportation or during processing. The insulation panels 200 can be formed in large blocks and cut into the corresponding panels 200 to form the desired dimensions and specifications for the particular application. The insulation panels 200 can further be cut to form the slot 208 and the recess 210 using a similar process. In at least one instance, the insulation panels 200, slots 208, and recesses 210 can be formed using a hot wire cutter.

The removed portion(s) can be stored and re-installed within the insulation panel 200 at various locations where a concrete tie 100 may not be needed. The insulation panel 200 can be cut using a strait wire cut or multiple strait wire cuts. In some instances, the insulation panel 200 can have recesses 210 and slots 208 removed from each of the side surface 206 and the removed portions can be re-installed where needed during construction based on the particular application and job parameters.

In some instances, a plurality of insulation panels 200 can be stacked for storage or transportation having concrete ties 100 coupled therewith. The concrete ties 100 can be coupled along one or more of the plurality of side surfaces 206. In some instances, the insulation panels 200 can be arranged in a staggered or alternating fashion to accommodate the concrete ties 100 installed therein as at least a portion of the concrete tie 100 can extend above and below the insulation panel 200.

The insulation panel(s) for use with a concrete tie of the present disclosure require minimal processing to accommodate and couple with the concrete tie. In some instances, the concrete tie of the present disclosure can be installed within the insulation layer prior to arrival at a job-site. The concrete tie can be installed and coupled with installation layer prior to shipment to the job-site, such that the insulation layer and concrete tie arrive in a "ready to use" condition. In some instances, the insulation layer arrives at the job-site with the appropriate slot and/or recess formed therein and ready for receipt of the concrete tie. In other instances, job-site installation requires only modification of the insulation layer with a slot for coupling with the protrusion of the concrete tie.

While the illustrated examples described above with respect to FIGS. 1-7 are drawn to a substantially horizontal insulated concrete panel, it is within the scope of this disclosure to form the insulated concrete panel in a vertical arrangement, or any angle between a horizontal orientation and a vertical orientation. The insulation panels are generally shown as rectangular panels but the concrete tie of the present invention can be implemented with insulation panels in any shape or polygon.

Moreover, while the present disclosure generally refers a concrete tie and the related insulated concrete panels, it is within the scope of this disclosure that the tie can be implemented within other building materials or applications requiring structural rigidity and the transfer of loads.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A concrete tie comprising:

a main body having a length, an inner surface and an outer surface;

a protrusion extending away from the inner surface and along the length of the main body;

at least one upper foot extending above a top surface of the main body; and at least one lower foot extending below a bottom surface of the main body, wherein the protrusion is configured to engage with a slot formed in an insulation sheet, wherein the main body has an upper width formed at the top surface, a middle width, and a lower width formed at the lower surface, the upper width and lower width being substantially similar and greater than the middle width, thus forming a substantially I-shaped main body, wherein the main body has an upper lip formed around a perimeter of the upper width and the at least one upper foot and a lower lip formed around a perimeter of the lower width and the at least one lower foot, the upper lip and the lower lip extending away from the inner surface of the main body.

2. The concrete tie of claim 1, wherein at least a portion of the protrusion extends above and/or below the insulation sheet.

3. The concrete tie of claim 1, wherein the at least one upper foot and the at least one lower foot extend substantially perpendicular from a top and/or bottom surface of the main body.

4. The concrete tie of claim 1, wherein the main body has an upper width formed at the top surface, a middle width, and a lower width formed at the lower surface, the upper width and lower width being substantially similar and greater than the middle width, thus forming a substantially I-shaped main body.

5. The concrete tie of claim 4, wherein the main body has an upper support rib extending across the middle width adjacent to the upper width and a lower support rib extending across the middle width adjacent to the lower width.

6. The concrete tie of claim 4, wherein the main body include two upper feet disposed at opposing ends of the upper width, and two lower feet disposed at opposing ends of the lower width.

7. The concrete tie of claim 1, wherein the at least one upper foot is configured to be received in an upper concrete layer.

8. The concrete tie of claim 1, wherein the at least one lower foot is configured to be received in a lower concrete layer.

9. A concrete tie system for an insulated concrete panel, the system comprising:

at least one concrete tie comprising:

a main body having a length, an inner surface and an outer surface;

a protrusion extending away from the inner surface and along the length of the main body;

at least one upper foot extending above a top surface of the main body;

at least one lower foot extending below a bottom surface of the main body; and an insulation sheet having a top surface, a bottom surface, and a plurality of side surfaces, the insulation sheet coupled with the at least one concrete tie and operable to receive the protrusion along at least one of the plurality of side surfaces.

10. The system of claim 9, further comprising a slot formed along one or more of the plurality of side surfaces, the slot configured to receive at least a portion of the protrusion extending from the at least one concrete tie.

11. The system of claim 10, wherein the slot has a depth equal to or greater than a depth of the protrusion, such that the protrusion is received within the slot and the outer surface of the concrete tie is substantially flush with one or more of the plurality of side surface.

12. The system of claim 9, wherein the concrete tie has an upper width formed at the top surface, a middle width, and a lower width formed at the lower surface, the upper width and lower width being substantially similar and greater than the middle width, thus forming a substantially I-shaped main body.

13. The system of claim 12, wherein the insulation sheet has a recess and a slot formed along one or more of the plurality of side surfaces, the recess configured to accommodate the middle width of the main body and the slot formed in the middle of the recess and configured to receive at least a portion of the protrusion extending form the at least one concrete tie.

14. The system of claim 9, wherein the insulation sheet has a plurality of slots formed on one of the plurality of side surfaces, each of the plurality of slots couplable with a concrete tie.

15. The system of claim 9, wherein the at least one upper foot extends above the top surface of the insulation sheet and the at least one lower extends below the bottom surface of the insulation sheet.

16. The system of claim 9, wherein the at least one upper foot and the at least one lower foot extend substantially perpendicular from the main body.

* * * * *